US009038657B2

(12) United States Patent
Wilkinson et al.

(10) Patent No.: US 9,038,657 B2
(45) Date of Patent: May 26, 2015

(54) FUEL SUPPLY SYSTEM HAVING A RECIRCULATION LOOP CAPABLE OF RETURNLESS OPERATION

(75) Inventors: Galen B. Wilkinson, Hudson, IA (US); Robert J. Fry, Waterloo, IA (US); Charles Klose, Cedar Falls, IA (US)

(73) Assignee: DEERE & COMPANY, Moline, IL (US)

( * ) Notice: Subject to any disclaimer, the term of this patent is extended or adjusted under 35 U.S.C. 154(b) by 1055 days.

(21) Appl. No.: 13/102,183

(22) Filed: May 6, 2011

(65) Prior Publication Data

US 2012/0279590 A1 Nov. 8, 2012

(51) Int. Cl.
*F02M 37/00* (2006.01)

(52) U.S. Cl.
CPC ..... *F02M 37/0052* (2013.01)

(58) Field of Classification Search
USPC ..... 137/334, 563; 123/514, 541, 557
See application file for complete search history.

(56) References Cited

U.S. PATENT DOCUMENTS

| | | | | |
|---|---|---|---|---|
| 4,187,813 | A * | 2/1980 | Stumpp | 123/541 |
| 4,411,239 | A * | 10/1983 | Kelch | 123/557 |
| 4,625,701 | A * | 12/1986 | Bartlett et al. | 123/514 |
| 6,868,838 | B2 * | 3/2005 | Piet | 123/541 |

* cited by examiner

*Primary Examiner* — Eric Keasel

(57) ABSTRACT

According to the present disclosure, a fuel supply system having a recirculation loop is provided. The fuel supply system comprises a fuel tank; a return line coupled fluidly to the fuel tank; a fuel manifold; and a recirculation loop, wherein the return line is coupled fluidly to the recirculation loop at a first node to return fuel from the recirculation loop to the fuel tank, and the recirculation loop comprises a heat exchanger positioned downstream of the fuel manifold and upstream of the first node. The recirculation loop may comprise an orifice positioned upstream of the heat exchanger and downstream of the fuel manifold. Additionally, the fuel supply system may further comprise a supply line coupled fluidly to the fuel tank and further coupled fluidly to the recirculation loop at a second node positioned upstream of the fuel manifold and downstream of the first node.

13 Claims, 3 Drawing Sheets

FUEL SUPPLY SYSTEM HAVING A RECIRCULATION LOOP CAPABLE OF RETURNLESS OPERATION

FIELD OF THE DISCLOSURE

The present disclosure relates to a fuel supply system. More particularly, the present disclosure relates to a fuel supply system having a recirculation loop capable of returnless operation during normal operating conditions.

BACKGROUND OF THE DISCLOSURE

Fuel supply systems have been developed that have a fuel tank, a fuel manifold, fuel injector filling ports, and fuel injectors. As fuel is drawn from the fuel tank, it initially flows through a primary filter. The fuel then travels through the fuel manifold and is heated by the operation of the fuel injectors. Some of the fuel is injected into one or more cylinders and combusted, while the rest of the fuel may flow through a heat exchanger and return to the fuel tank. Some fuel supply systems contain a recirculation loop, wherein a high fuel flow rate is maintained in the recirculation loop, but a portion of the fuel exits the recirculation loop and flows through a heat exchanger and to the fuel tank. Ideally, functional and reliable fuel supply systems should have the following characteristics:

- a fuel flow rate that is greater than a required minimum fuel flow rate through the fuel manifold;
- a fuel pressure in the fuel manifold that is higher than a required minimum fuel pressure;
- a fuel temperature, adjacent to the injector filling ports, that is lower than a maximum fuel temperature, which ensures reliable operation of the fuel injectors;
- a low fuel pressure (ideally at atmospheric pressure) within the heat exchanger for minimizing the risk of fuel leakage from the heat exchanger;
- a low fuel flow rate back to the fuel tank (ideally zero) for minimizing the addition of heat, from the fuel, to the fuel tank;
- a low fuel flow rate from the fuel tank (ideally consumed fuel only) to minimize the debris carried from the tank, for extending the life of, for example, the primary fuel filter, and
- a low fuel flow rate through, for example, the primary fuel filter for minimizing the risk of rupturing the primary fuel filter.

Prior fuel supply systems without a recirculation loop fail to meet these design requirements simultaneously. In particular, prior fuel supply systems without a recirculation loop have had a high fuel flow rate back the fuel tank, and they have consequently had a high fuel flow rate from the tank and through the primary fuel filter. This unnecessarily shortens the lifespan of the primary fuel filter and puts the primary fuel filter at risk of having a ruptured filter element.

Likewise, Prior fuel supply systems having a recirculation loop have also failed to meet these design requirements simultaneously. For example, in such systems, if the return flow rate back to tank is too low, the heat exchanger in the return line is unable to remove sufficient heat from the fuel. In contrast, if the return flow rate back to tank is too high, then there will also be a high flow rate through the tank and the primary fuel filter. Again, this unnecessarily shortens the lifespan of the primary fuel filter and puts the primary fuel filter at risk of having a ruptured filter element.

Ultimately, what is needed in the art is a fuel supply system having as many of the aforementioned characteristics as possible.

SUMMARY OF THE DISCLOSURE

According to the present disclosure, a fuel supply system is provided. The fuel supply system comprises a fuel tank; a return line coupled fluidly to the fuel tank; a fuel manifold; and a recirculation loop, wherein the return line is coupled fluidly to the recirculation loop at a first node to return fuel from the recirculation loop to the fuel tank, and the recirculation loop comprises a heat exchanger positioned downstream of the fuel manifold and upstream of the first node. The recirculation loop may comprise an orifice positioned upstream of the heat exchanger and downstream of the fuel manifold. Further, the fuel supply system may comprise a supply line coupled fluidly to the fuel tank and also coupled fluidly to the recirculation loop at a second node positioned upstream of the fuel manifold and downstream of the first node.

Further yet, the recirculation loop may comprise a pressure control valve positioned upstream of the first node and downstream of the fuel manifold; a bypass line positioned between the first node and the second node, wherein the bypass line comprises a one way valve that opens fluidly away from the heat exchanger; a pumping system positioned downstream of the second node and upstream of the fuel manifold; and a filter positioned downstream of the second node and upstream of the fuel manifold.

The disclosed system has many of the previously mentioned, desired characteristics. First, during normal operating conditions, the disclosed system provides a fuel flow rate that is greater than a required minimum fuel flow rate through the fuel manifold. Next, during normal operating conditions, the fuel pressure in the manifold is above the required minimum value. The fuel pressure is controlled by the combination of orifice and pressure control valve, which are downstream of the fuel manifold. Further, as the fuel flows past the injector filling ports, the fuel temperature is under the maximum desired fuel temperature. The fuel temperature is controlled via the heat exchanger, which is positioned, in the recirculation loop, and downstream of the fuel manifold. Further yet, the disclosed system minimizes the fuel pressure within the heat exchanger. The fuel pressure in the heat exchanger is low, because upstream of the heat exchanger, the combination of orifice and the pressure control valve causes a pressure drop. Further yet, in the disclosed system, there is a low fuel flow rate back to the fuel tank. In the disclosed system, during normal operating conditions, all of the fuel recirculates through the recirculation loop and, therefore, does not return to the fuel tank. Further yet, in the disclosed system, there is a low fuel flow rate from the fuel tank. During normal operating conditions, the fuel flow rate from the tank is equal to the fuel consumption rate of the engine. Finally, in the disclosed system, there is a low fuel flow rate through the primary fuel filter. The fuel flow rate through the primary fuel filter is equal to the fuel flow rate from the fuel tank. During normal operating conditions, as stated above, this is equal to the fuel consumption rate of the engine, instead of the much higher flow rate in the recirculation loop.

BRIEF DESCRIPTION OF THE DRAWINGS

The detailed description of the drawings refers to the accompanying figures in which.

DETAILED DESCRIPTION OF THE DRAWINGS

First Fuel Supply System's Structure

Figure 1:
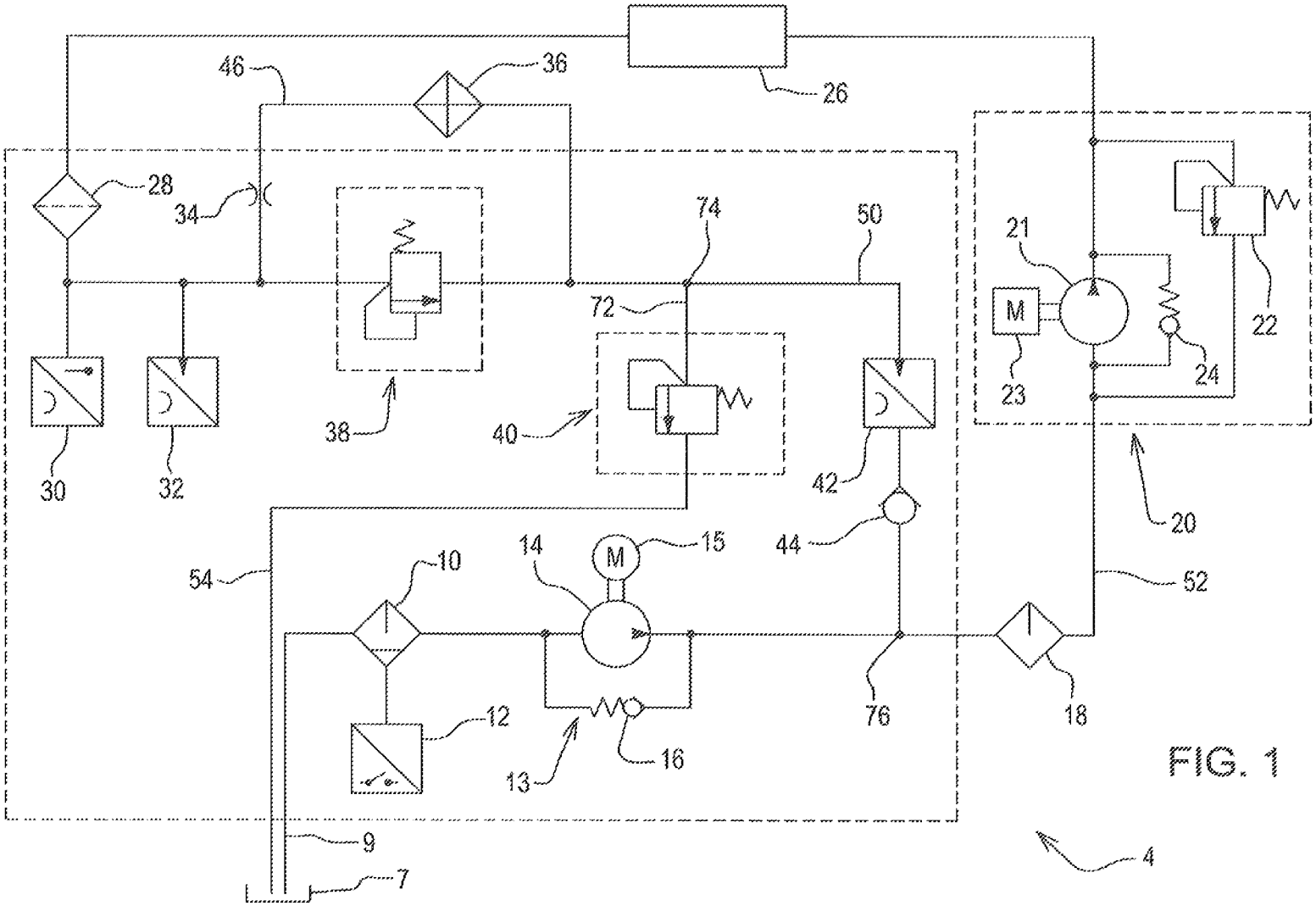
FIG. 1. is a diagrammatic view of a first fuel supply system.

Referring to FIG. 1, there is shown a first diagrammatic view of a first fuel supply system 4. The first system 4 comprises a fuel tank 7; a return line 54 coupled fluidly to the fuel tank 7; a fuel manifold 26; and a recirculation loop 52, wherein the return line 54 is coupled fluidly to the recirculation loop 52 at a first node 74 to return fuel from the recirculation loop 52 to the fuel tank 7, and the recirculation loop 52 comprises a heat exchanger 36 positioned downstream of the fuel manifold 26 and upstream of the first node 74. The return line 54 may further comprise a second pressure control valve 40.

Downstream of the fuel manifold 26 and upstream of the heat exchanger 36, the recirculation loop 52 may comprise a screener 28, a temperature sensor 30, and a first pressure sensor 32. The screener 28 may be part of a fitting (not shown) attached to the fuel manifold 26 for potentially catching debris resulting from assembly operations. Within the fuel manifold 26, there may be one or more injector filling ports (not shown) and fuel injectors (not shown). Additionally, the fuel manifold 26 may be a fuel rail. The temperature sensor 30 may be in communication with an ECU (not shown) for controlling the injection characteristics of the fuel injectors (not shown). The first pressure sensor 32 may also be in communication with the ECU (not shown) to determine, for example, whether the first system 4 is behaving as expected.

The recirculation loop 52 may further comprise an orifice 34 positioned upstream of the heat exchanger 36 and downstream of the fuel manifold 26. Further, the recirculation loop 52 may comprise a pressure control valve 38 positioned upstream of the first node 74 and downstream of the fuel manifold 26. Further yet, the recirculation loop 52 may comprise a heat exchange line 46 positioned in parallel with the pressure control valve 38, wherein the heat exchanger 36 is positioned in the heat exchange line 46. The heat exchange line 46 further comprises an orifice 34, and the orifice 34 is positioned upstream of the heat exchanger 36.

The first system 4 may further comprise a supply line 9 coupled fluidly to the fuel tank 7 and further coupled fluidly to the recirculation loop 52 at a second node 76 positioned upstream of the fuel manifold 26 and downstream of the first node 74. The supply line 9 may comprise a primary fuel filter 10 and a priming system 13. The priming system 13 may comprise an electric motor 14 and a priming pump 15. The electric motor 14 may be in communication with the ECU (not shown). Further, the priming pump 15, which may also be referred to as a lift pump, may be a positive displacement pump and may be, more particularly, a gerotor. The recirculation valve 16 may be a check valve. The priming system may further comprise a recirculation valve 16. The recirculation valve 16 prevents damage to the first system 4 and, in particular, prevents the filter 18 from blowing out.

It is possible that the fuel may contain contaminants resulting from the refueling process and/or corrosion of the fuel tank 7. The primary fuel filter 10, which may be a 10 micron filter having a manual drain, is positioned such that it can cull, as least some of, these contaminants from the fuel. The primary fuel filter 10 may comprise a water sensor 12 and a water separator (not shown). The water sensor 12 may be capable of determining when the water separator (not shown) is full of water and further capable of sending a signal to an operator, which may indicate to the operator that he should empty the water separator (not shown).

The recirculation loop 52 may further comprise a bypass line 50 positioned between the first node 74 and the second node 76, wherein the bypass line 50 comprises a one way valve 44 that opens fluidly away from the heat exchanger 36. The bypass line 50 may also comprise a second pressure sensor 42. The second pressure sensor 42 may communicate with the ECU (not shown).

The recirculation loop 52 may further comprise a pumping system 20 positioned downstream of the second node 76 and upstream of the fuel manifold 26. The pumping system 20 may comprise a pump 21, a bypass valve 24, and a pumping system pressure control valve 22. The pump 21 may be a positive displacement pump or, more particularly, a gerotor. The pumping system 20 may also comprise a camshaft 23, wherein the camshaft 23 rotates the pump 21.

The recirculation loop 52 may also comprise a filter 18 positioned downstream of the second node 76 and upstream of the pumping system 20. Alternatively, the filter 18 may also be positioned downstream of the pumping system 20 and upstream of the fuel manifold 26. If the filter 18 is placed downstream of pumping system 20, pump pressure regulating valve 22 prevents damage to the filter 18 if the pressure immediately upstream of the filter 18 becomes too high. The filter 18 may be, for example, a 2 micron filter.

The lines and loop discussed above—such as the supply line 9, the heat exchange line 46, the bypass line 50, the return line 54, and the recirculation loop 52—may be exemplarily made of steel, rubber, or a combination of steel and rubber (i.e., braided). A steel line may be appropriate when the parts being fluidly connected do not move. Alternatively, a rubber line or a combination of steel and rubber line may be appropriate when the parts being fluidly connected move relative to one another.

Priming of the First Fuel Supply System

When priming the first system 4, the electric motor 14 rotates the priming pump 15, and the priming pump 15 draws fuel from the fuel tank 7. As the fuel is drawn from the fuel tank 7, the fuel enters the primary fuel filter 10, and the primary fuel filter 10 draws, at least some of, the impurities that may be in the fuel. After the fuel flows through the primary fuel filter 10 and the priming system 13, a portion of the fuel flows into the bypass line 50 and a portion of the fuel flows into the recirculation loop 52. The one way valve 44 blocks the portion of the fuel that flows into the bypass line 50 and prevents it from flowing to the heat exchanger 36 without first flowing through the fuel manifold 26. The portion of the fuel that flows into recirculation loop 52 flows through the bypass valve 24—rather than through the pump 21—because the camshaft 23 and pump 21 are stationary. Further, that portion of the fuel also flows through filter 18. As previously noted, the filter 18 may be positioned either upstream or downstream of the pumping system 20.

Next, the fuel flows through the fuel manifold 26. As the first system 4 is only being primed, no fuel is injected into the engine cylinders (not shown) from the fuel manifold 25, because the fuel injectors (not shown) are not operating. Rather, the fuel flows through the fuel manifold 26 and may then flow through a screener 28 and a heat exchanger 36. Typically, the fuel, during priming, does not flow through the pressure control valve 38, because the pressure and flow rate generated by the priming pump 14 is not high enough to open control valve 38.

As the fuel exits the heat exchanger 36, a portion of the fuel flows into the bypass line 50, and a portion of the fuel flows into the return line 54. During priming, the one way valve and the portion of the fluid downstream of the one way valve will cooperate and block the portion of the fuel that flows into the bypass line 50. At this time, the priming pump 14 generates a pressure higher than the opening pressure of the second pressure control valve 40. Hence, the portion of the fuel that flows into the return line 54 will apply pressure to the second pressure control valve 40, until it opens fluidly, and will thus enter the fuel tank 7. Eventually, after doing all of the aforementioned, for some period of time, the first system 4 will purge itself of any air or other vapors that may have been present.

Normal Operating Conditions of the First Fuel Supply System

During normal operating conditions, the electric motor 14 rotates the priming pump 15, and the priming pump 15 draws fuel from the fuel tank 7. As the fuel is drawn from the fuel tank 7, the fuel enters the primary fuel filter 10, and the filter 10 draws at least some of the impurities that may be in the fuel. After the fuel flows through the primary fuel filter 10 and the priming system 13, a portion of the fuel flows into the bypass line 50 and a portion of the fuel flows into the recirculation loop 52. The one way valve 44 blocks the portion of the fuel that flows into the bypass line 50 and prevents it from flowing to the heat exchanger 36 without first flowing through the fuel manifold 26. During normal operating conditions, the camshaft 23 rotates, which then rotates the pump 21. As such, the portion of the fuel that flows into recirculation loop 52 is drawn via pump 21. Further, that portion of the fuel also flows through filter 18, which—as previously noted—may be positioned either upstream or downstream of the pumping system 20. The filter 18 removes, among other things, any remaining impurities that the fuel may have carried from the fuel tank 7, and the filter 18 additionally removes any impurities that the fuel may have carried from the heat exchanger 36 (i.e., impurities left from manufacturing the heat exchanger 36).

Next, the fuel flows into the fuel manifold 26, wherein a portion of the fuel exits the fuel manifold 26 via, for example, fuel injectors (not shown), while the remaining portion of the fuel exits the fuel manifold 26 and continues flowing though the recirculation loop 52. Following this, the fuel may flow through a screener 28 and may, then, flow through the heat exchange line 46. In the heat exchange line 46, the orifice 34 ensures that adequate fuel pressure is maintained within fuel manifold 26. At the same time, the orifice 34 lowers the fuel pressure within the heat exchanger 36 and, thus, prevents potential leaks. Orifice 34 may be of the largest size possible such that the minimum required pressure, in the fuel manifold 26, can still be maintained at the lowest operating speed of the engine, which usually occurs at low idle speed.

During some operating conditions, above the lowest operating speed of the engine, the fuel pressure immediately upstream of the pressure control valve 38 may open it. As the pressure control valve 38 opens fluidly and closes, it helps to maintain the fuel pressure in the fuel manifold 26 at a regulated, constant value. The pressure control valve 38 also helps to prevent the fuel pressure within the heat exchanger 36, from becoming too high and, further, prevent the fuel from potentially leaking from the heat exchanger 36.

During normal operating conditions, after the fuel flows through the heat exchange line 46 and through the pressure control valve 38, the fuel should flow repeatedly through the bypass line 50 (including the one way valve 44) and back through the fuel manifold 26. At this time, the priming pump 14 generates a pressure that is below the opening pressure of the second pressure control valve 40. Hence, during normal operating conditions, the second pressure control valve 40 will remain closed and block hot fuel from flowing back to the fuel tank 7.

Often times, it is advantageous for the fuel to flow through the bypass line 50. This may advantageous because the hot fuel that passes through the bypass line 50, does not flow back to the fuel tank 7 and unnecessarily heat it. This may also advantageous because the fuel flows through the bypass line 50 and, therefore, the primary fuel filter 10 only cleanses the portion of the fuel that is drawn via the priming system 13. When this occurs, the primary fuel filter 10 must only filter a very low flow rate, potentially resulting in longer service intervals and a lower risk of filter element (not shown) failure.

Conversely, it may sometimes be advantageous to heat the fuel in fuel tank 7 in, for example, cold ambient conditions for preventing waxing and gelling. When this occurs, the priming pump 14—in conjunction with, for example, the ECU (not shown)—may generate a pressure sufficient to open the second pressure control valve 40. Further, when this occurs, some of the fuel, which is relatively hot compared to the fuel in the fuel tank 7, will flow through return line 54 and back to the fuel tank 7. Ultimately, this raises the temperature of the fuel in the fuel tank 7.

Second Fuel Supply System's Structure

Figure 2:
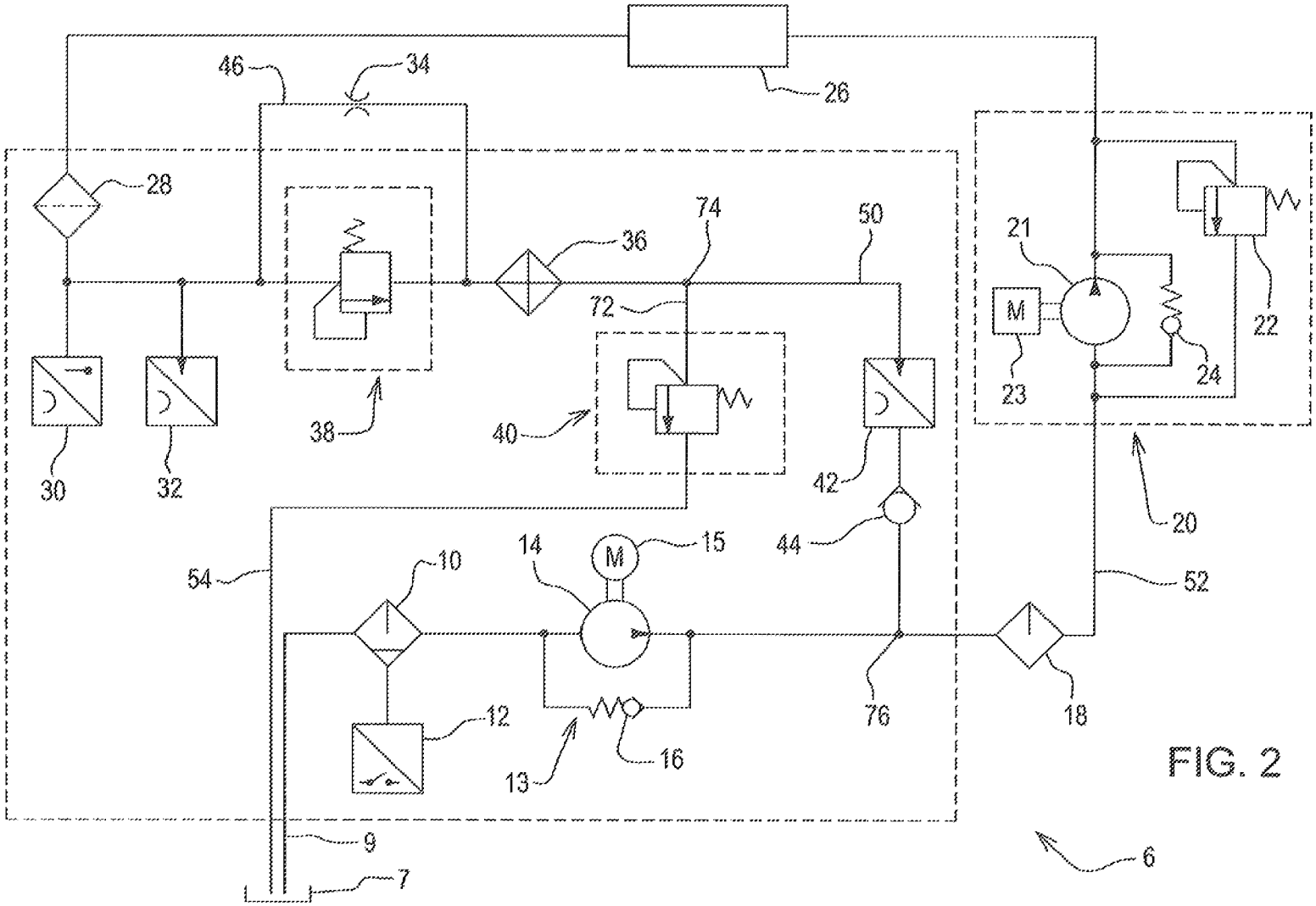
FIG. 2 is a diagrammatic view of a second fuel supply system.

Referring now to FIG. 2, there is shown a diagrammatic view of a second fuel supply system 6. In the second system 6, the recirculation loop 52 comprises an orifice 34 in parallel with the pressure control valve 38. Conversely, in the first system 4, the recirculation loop 52 comprises a heat exchange line 46 positioned in parallel with the pressure control valve 38, wherein the heat exchanger 36 is positioned in the heat exchange line 46, and the heat exchange line 46 comprises an orifice 34 positioned upstream of the heat exchanger 36.

Despite this difference, between the first and second systems 4, 6, the second system 6 has several components similar in structure and function as the first system 4, as indicated by the use of identical reference numbers where applicable. These components—even though similar in structure and function—may have slightly different design characteristics (i.e., pressure control valve cracking pressures).

Priming of the Second Fuel Supply System

Priming of the second system 6 is similar to the priming of the first system 4. However, one difference is the following: In the first system 4, during priming, the fuel flows through the heat exchange line 46, but in the second system 6, the fuel flows through orifice 34 and the heat exchanger 36.

Additionally, note that, in the second system 6, the orifice 34 may be designed such that it provides an adequate flow rate through the recirculation loop 52 during priming of the system, even though the pressure upstream of the pressure control valve 38 is too low to open it.

Normal Operating Conditions of the Second Fuel Supply System

During normal operating conditions, the second system 6 functions similarly to the first system 4. However, note that in the first system 4, during normal operating conditions, fuel flows through the heat exchange line 46—which is in parallel with the pressure control valve 38—or, more specifically, the fuel flows through the orifice 34 and the heat exchanger 36. During normal operating conditions, in the second system 6, the fuel also flows through the orifice 34 and the heat exchanger 36 but in a slightly different manner. In the second system 6, the orifice 34 is in parallel with the pressure control valve 38. Additionally, in the second system 6, the heat exchanger 36 is in series with the parallel arrangement of the orifice 34 and the pressure control valve 38. One benefit of the second system 6 is that all of the fuel flowing from the fuel manifold 26 must also flow through the heat exchanger 36, even if the fuel pressure upstream of the pressure control valve 38 causes the pressure control valve 38 to open. Consequently, all of the fuel exiting the fuel manifold 26 (rather than combusted) is cooled in the heat exchanger 36.

During normal operating conditions, the pressure control valve 38 will often times be open. When it is, it maintains the fuel pressure in the fuel manifold 26 at a regulated, constant value. Similar to the first system, the pressure downstream of the heat exchanger 36 will be the pressure set by priming pump 14, and there will be less risk of the heat exchanger 36 leaking.

Third Fuel Supply System Structure

Figure 3:
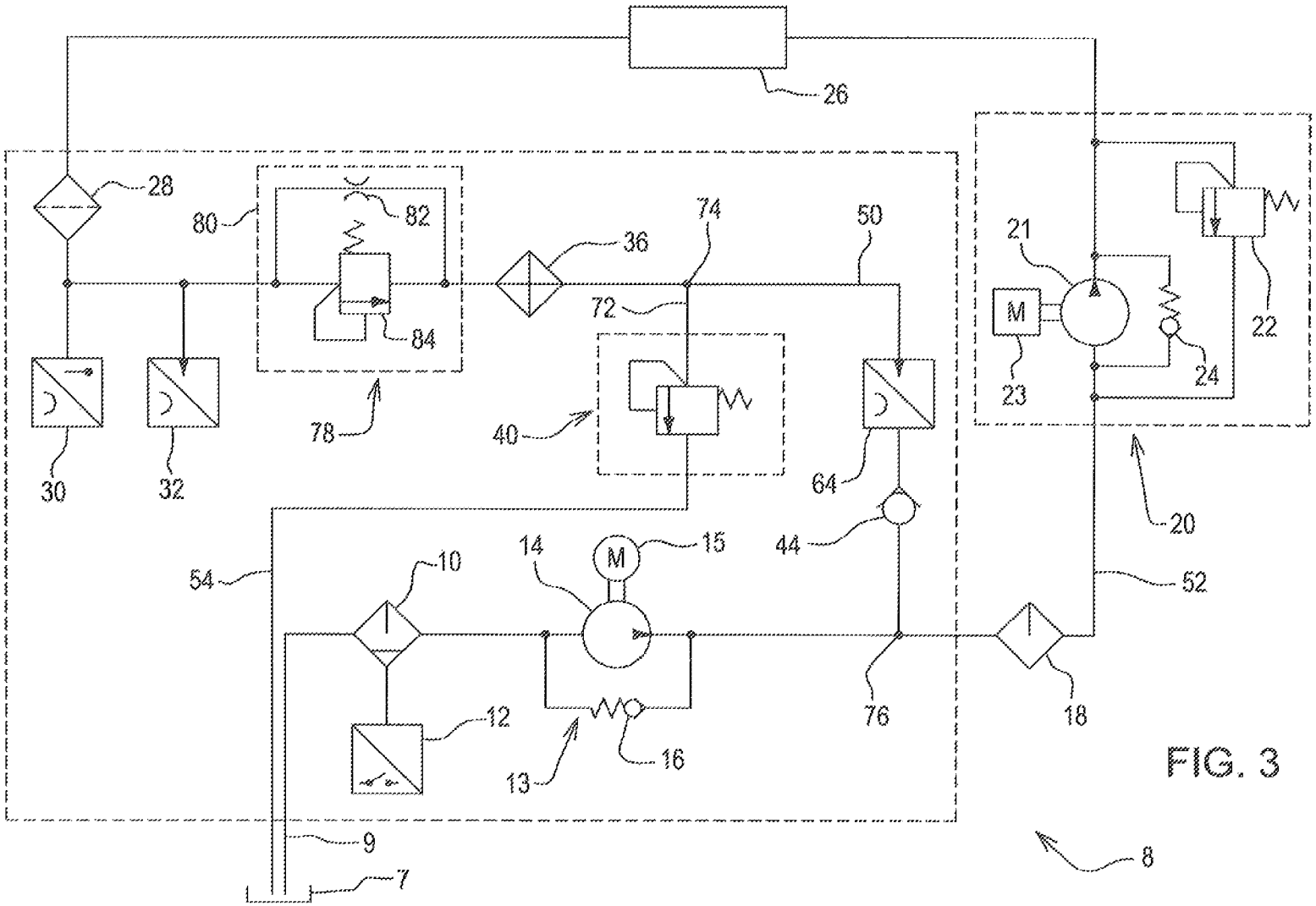
FIG. 3 is a diagrammatic view of a third fuel supply system.

Referring now to FIG. 3, there is shown a diagrammatic view of a third fuel supply system 8. A difference between the second system 6 and the third system 8 is that, in the third system 8, there is a pressure control valve 78 comprising a housing 80, an orifice 82 positioned in the housing 80, and a valve element 84 also positioned in the housing 80. The orifice 82 may be, for example, a hole (not shown) drilled through the valve element 84. Conversely, in the second system 6, the recirculation loop 52 comprises an orifice 34 in parallel with the pressure control valve 38.

The third system 8 has several components similar in structure and function as the second system 6, as indicated by the use of identical reference numbers where applicable. These components—even though similar in structure and function—may have slightly different design characteristics (i.e., pressure control valve cracking pressures).

Priming of the Third Fuel Supply System

Priming of the third system 8 is similar to the priming of the second system 6. In the second system 6, the fuel flows through orifice 34, and similarly, in the third system 8, the fuel flows through orifice 82. However, in the second system 6, orifice 34 is in parallel and separate from the pressure control valve 38, while in the third system 8, the orifice 82 is positioned within the pressure control valve 78. During priming, in the second system 6, the fuel flows through orifice 34. Likewise, in the third system 8, the fuel flows through 82. Apart from this, priming of the second system 6 is quite similar to priming of the third systems 8.

Normal Operating Conditions of the Third Fuel Supply System

During normal operating conditions, the third system 8 functions similarly to the second system 6. As stated above, in the second system 6, orifice 34 is in parallel and separate from the pressure control valve 38. But in the third system 8, the orifice 82 is positioned within the pressure control valve 78. These two arrangements function similarly, even though they are slightly different mechanically. One potential advantage of the third system 8 is that the orifice 82 is within the housing 80. As a result, the third system 8 and, more specifically, the pressure control valve 78, may be easier to construct, be less expensive, and consume less space than the combination of the orifice 34 and the pressure control valve 38 shown in the second system 6.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. A fuel supply system, comprising:

a fuel tank;

a return line coupled fluidly to the fuel tank;

a fuel manifold;

a recirculation loop, wherein the return line is coupled fluidly to the recirculation loop at a first node to return fuel from the recirculation loop to the fuel tank, and the recirculation loop comprises a heat exchanger positioned downstream of the fuel manifold and upstream of the first node; and a supply line coupled fluidly to the fuel tank, and further coupled fluidly to the recirculation loop at a second node positioned upstream of the fuel manifold and downstream of the first node, wherein the recirculation loop further comprises a bypass line positioned between the first node and the second node, and wherein the bypass line comprises a one way valve that opens fluidly away from the heat exchanger.

2. The fuel supply system of claim 1, wherein the recirculation loop comprises an orifice positioned upstream of the heat exchanger and downstream of the fuel manifold.

3. The fuel supply system of claim 2, wherein the recirculation loop comprises:

a pressure control valve positioned upstream of the first node and downstream of the fuel manifold;

a pumping system positioned downstream of the second node and upstream of the fuel manifold; and a filter positioned downstream of the second node and upstream of the fuel manifold.

4. The fuel supply system of claim 1, wherein the recirculation loop comprises a pressure control valve positioned upstream of the first node and downstream of the fuel manifold.

5. The fuel supply system of claim 4, wherein the recirculation loop further comprises a heat exchange line positioned in parallel with the pressure control valve, the heat exchanger is positioned in the heat exchange line, and the heat exchange line comprises an orifice positioned upstream of the heat exchanger.

6. The fuel supply system of claim 5, wherein the recirculation loop further comprises:

a pumping system positioned downstream of the second node and upstream of the fuel manifold; and a filter positioned downstream of the second node and upstream of the pumping system.

7. The fuel supply system of claim 5, wherein the recirculation loop further comprises:

a pumping system positioned downstream of the second node and upstream of the fuel manifold; and a filter positioned downstream of the pumping system and upstream of the fuel manifold.

8. The fuel supply system of claim 4, wherein the recirculation loop comprises an orifice in parallel with the pressure control valve.

9. The fuel supply system of claim 8, wherein the recirculation loop further comprises:

a pumping system positioned downstream of the second node and upstream of the fuel manifold; and a filter positioned downstream of the second node and upstream of the pumping system.

10. The fuel supply system of claim 8, wherein the recirculation loop further comprises:

a pumping system positioned downstream of the second node and upstream of the fuel manifold; and a filter positioned downstream of the pumping system and upstream of the fuel manifold.

11. The fuel supply system of claim 4, wherein the pressure control valve comprises:

a housing;

an orifice positioned in the housing; and a valve element also positioned in the housing.

12. The fuel supply system of claim 11, wherein the recirculation loop further comprises:

a pumping system positioned downstream of the second node and upstream of the fuel manifold; and a filter positioned downstream of the second node and upstream of the pumping system.

13. The fuel supply system of claim 11, further comprising a supply line coupled fluidly to the fuel tank, and further coupled fluidly to the recirculation loop at a second node positioned upstream of the fuel manifold and downstream of the first node, wherein the recirculation loop further comprises:

a pumping system positioned downstream of the second node and upstream of the fuel manifold; and a filter positioned downstream of the pumping system and upstream of the fuel manifold.

* * * * *